US009837060B2

(12) United States Patent
Dobryniewski

(10) Patent No.: US 9,837,060 B2
(45) Date of Patent: Dec. 5, 2017

(54) SYSTEM AND METHOD FOR STRINGED INSTRUMENTS' PICKUP

(71) Applicant: ADVANCED DIGITAL BROADCAST S.A., Eysins (CH)

(72) Inventor: Jacek Dobryniewski, Zielona Gora (PL)

(73) Assignee: ADVANCED DIGITAL BROADCAST S.A., Eysins (CH)

( * ) Notice: Subject to any disclaimer, the term of this patent is extended or adjusted under 35 U.S.C. 154(b) by 0 days.

(21) Appl. No.: 15/456,600

(22) Filed: Mar. 13, 2017

(65) Prior Publication Data

US 2017/0270903 A1 Sep. 21, 2017

(30) Foreign Application Priority Data

Mar. 15, 2016 (EP) ..... 16160274

(51) Int. Cl.
*G10H 1/00* (2006.01)
*G10H 1/14* (2006.01)

(52) U.S. Cl.
CPC ..... *G10H 1/14* (2013.01); *G10H 1/0008* (2013.01); *G10H 1/0066* (2013.01); *G10H 2220/455* (2013.01); *G10H 2250/551* (2013.01)

(58) Field of Classification Search
CPC ..... G06K 1/126; G10H 2210/066; G10H 2240/311; G10H 1/02; G10H 2210/031; G10H 2210/056; G10H 2220/091; G10H 2250/511; G06T 1/0007; G06T 7/70; G06T 7/90; G10C 3/00; G10D 3/003; G10D 17/00; G10D 1/085; G10G 1/02; G10G 1/04
See application file for complete search history.

(56) References Cited

U.S. PATENT DOCUMENTS 5,488,196 A * 1/1996 Zimmerman ..... G10H 1/0033 84/612
6,529,843 B1 * 3/2003 Carpenter ..... G10G 7/02 702/75
2002/0007717 A1 * 1/2002 Uehara ..... G10H 1/0008 84/600

(Continued)

*Primary Examiner* — Marlon Fletcher
(74) *Attorney, Agent, or Firm* — Mark M. Friedman

(57) ABSTRACT

A method for stringed instruments' pickup, the method comprising a step of: capturing mechanical vibrations of at least one string; and converting them to a signal representative of a string's current state, the method being characterized in that the capturing comprises the following steps: capturing, using an image capturing device, image frames comprising views of at least one musical instrument's string in a still state; storing the captured image as a reference of a still state; capturing (500), using the image capturing device, image frames comprising views of at least one musical instrument's string in a vibrating state; storing the captured image as a reference of a vibrating state; comparing (520) the still state reference with a vibrating state reference in order to find (530) amplitude of vibrations of each string as well as frequency of each string vibrations based on amplitude height in pixels with reference to the still state and determining a frequency of each vibrating string on the basis of the number of pixels between two nuts of at least half-period of a given periodic function.

11 Claims, 9 Drawing Sheets

(56) References Cited

U.S. PATENT DOCUMENTS

| | | | | |
|---|---|---|---|---|
| 2009/0308232 | A1* | 12/2009 | McMillen | G10D 3/16 84/723 |
| 2011/0003638 | A1* | 1/2011 | Lee | G09B 15/00 463/35 |
| 2014/0140536 | A1* | 5/2014 | Serletic, II | G06F 3/0481 381/98 |
| 2016/0267895 | A1* | 9/2016 | Jeon | G10H 1/32 |

* cited by examiner 803A 801

$$f_{Sound} = \frac{1}{2 \cdot (t_{Node2} - t_{Node1})}$$

615 614

803B 802

$$f_{Sound} = \frac{1}{2 \cdot (t_{Min} - t_{Max})}$$

716 713

Fig. 8

SYSTEM AND METHOD FOR STRINGED INSTRUMENTS' PICKUP

TECHNICAL FIELD

The present invention relates to a system and method for stringed instruments' pickup. In particular, the present invention relates to a pickup device, which is a transducer that captures mechanical vibrations from stringed instruments such as an electric guitar, an electric bass guitar, a harp or an electric violin, and converts them to an electrical signal that is representative of a string current state.

BACKGROUND OF THE INVENTION

Known solutions of converting vibrations of strings, in musical instruments, into electric signals involve typically a use of coils.

A ferromagnetic string passing through the magnetic field induces electric current in the coil wound on a pole of a permanent magnet. The electric current induced in this way has the same frequency as the frequency of the vibrating string. Obtained in this way signal is amplified and played back by a speaker at much higher power.

This solution is very prone to electromagnetic interference due to the high sensitivity of such solutions needed for high efficiency in converting musical instrument string vibrations into electric signals.

Moreover, the need of connecting such sound sensors to potentiometers for volume and tone control as well as to the outlet socket pose additional problems for interference-free sound signal transmission especially at the stage where the level of signals is very small and prone to unwanted signal interference.

One additional limitation is a necessity of having a ferromagnetic string in a musical instrument, which is needed to induce electric current in the pick-up coils. This way of transforming the vibration of strings into electric signal is not suitable for instruments having nylon or gut strings which do not induce electric current in coil based pick-up systems.

Another way of transforming vibrations of physical elements into electric signal involves the use of microphones or piezo-electric devices. Both solutions transform vibrations of air or mechanical elements onto electric signals, which are subject of further processing or amplification.

With piezo-electric sound pick-ups or microphones there is no necessity of having ferromagnetic strings, but instrument producers face problems with unwanted feedback, crosstalk or noise interference at the early stage of sound signal processing and amplification.

Other, less popular and practically hardly implemented, known solutions of converting the vibrations of strings into electric signals apply the use of optic sensors as described in U.S. Pat. No. 8,546,677, where an emitted light stream or laser beam or any other form of electromagnetic waves of different length is interrupted by the vibrating string and the optical sensor receiving the interrupted in this way light/infrared stream or reflections are the source of the string frequency response.

In a way, this solution is similar to the coil based pick-up with the difference that instead of the magnetic field interrupted by the vibrating ferromagnetic string it is the emitted light that gets interrupted by the vibrating string and received by a suitably placed light sensor.

Although the employment of light or any other form of electromagnetic waves of various length decreases the unwanted noise interference signals being a major problem with magnetic coil, microphone, or piezo based solutions, it cannot produce any form of information about the way of sound generation related to the physical application of force inducing the string vibration.

This information, called in music "sound articulation", can only be heard when the sensed and amplified sound is reproduced by a speaker. In electronic music sound modules, information about sound articulation is described by the duration and dynamics of sound. This may be regarded as a limitation in musical expression especially when musicians use electronic stringed instruments and MIDI based sound modules.

An advantage of keyboard instruments over stringed instruments in MIDI electronic sound systems have led to the search of other means of collecting information about the produced by a stringed instrument sound.

In view of the above, the aim of the development of the present invention is an improved or at least alternative system and method for stringed instruments' pickup.

SUMMARY AND OBJECTS OF THE PRESENT INVENTION

An object of the present invention is a method for stringed instruments' pickup the method comprising a step of: capturing images of mechanical vibrations of at least one string; and converting them to a signal representative of a string's current state, the method being characterized in that the capturing comprises the following steps: capturing, using an image capturing device, image frames comprising views of at least one musical instrument's string in a still state; storing the captured image as a reference of a still state; capturing, using the image capturing device, image frames comprising views of at least one musical instrument's string in a vibrating state; storing the captured image as a reference of a vibrating state; comparing the still state reference with a vibrating state reference in order to find amplitude of vibrations of each string as well as frequency of each string vibrations based on amplitude height in pixels with reference to the still state and determining a frequency of each vibrating string on the basis of the number of pixels between two nuts of at least half-period of a given periodic function.

Preferably, the rate with which the frames are delivered is controlled by a clock and is at least twice as high as the highest frequency a given musical stringed instrument is able to produce.

Preferably, before the comparing step, an image processing step is executed where the irrelevant elements of the captured scene as well as the elements which carry meaningful information are identified.

Preferably, the method further comprises a step wherein the obtained information of amplitude and frequency of at least one vibrating string is matched with corresponding MIDI messages that are capable of driving external MIDI sound modules or sound synthesis modules.

Preferably, the given periodic function is a sine or cosine.

Preferably, the image capturing device viewing axis creates an angle with the still string axis in the range of 0 to 90 degrees.

Preferably, determining the frequency includes calculating a time per pixel on the basis of a known calibrating frequency of a vibrating string, and a number of pixels between two nodes (613) of half-period and applying the following formula:

$$f_{Sound} = \frac{1}{2 \cdot (t_{Node\ 2} - t_{Node\ 1})}$$

Preferably, the comparing step is based on a correlation of a still string axis, and the camera viewing axis, and the most distant pixel's trajectory axis.

Preferably, the information about the sound frequency and amplitude, produced by the stringed instrument, takes place in time intervals equal to the full vibration period of the highest tone a musical stringed instrument is able to produce.

Another object of the present invention is a computer program comprising program code means for performing ail the steps of the computer-implemented method according to the present invention when said program is run on a computer.

Another object of the present invention is a computer readable medium storing computer-executable instructions performing all the steps of the computer-implemented method according to the present invention when executed on a computer.

BRIEF DESCRIPTION OF THE DRAWINGS

These and other objects of the invention presented herein, are accomplished by providing a system and method for stringed instruments' pickup. Further details and features of the present invention, its nature and various advantages will become more apparent from the following detailed description of the preferred embodiments shown in a drawing, in which:

FIG. 8 shows relevant equations.

NOTATION AND NOMENCLATURE

Figure 1:
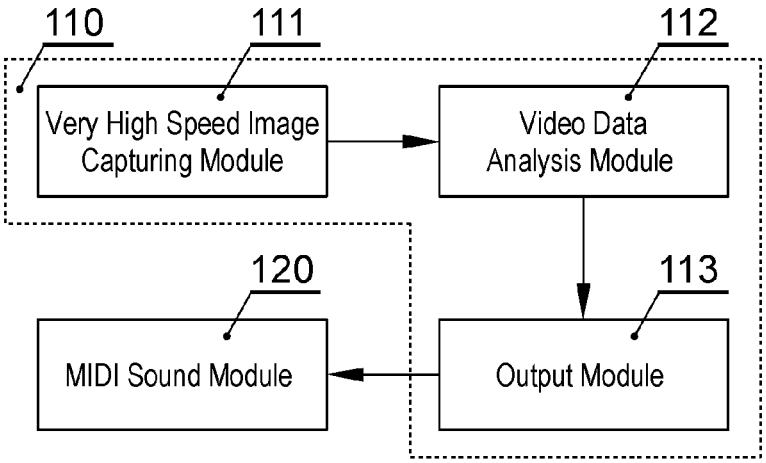
FIG. 1 presents a diagram of the system according to the present invention.

Some portions of the detailed description which follows are presented in terms of data processing procedures, steps or other symbolic representations of operations on data bits that can be performed on computer memory. Therefore, a computer executes such logical steps thus requiring physical manipulations of physical quantities.

Usually these quantities take the form of electrical or magnetic signals capable of being stored, transferred, combined, compared, and otherwise manipulated in a computer system. For reasons of common usage, these signals are referred to as bits, packets, messages, values, elements, symbols, characters, terms, numbers, or the like.

Additionally, all of these and similar terms are to be associated with the appropriate physical quantities and are merely convenient labels applied to these quantities. Terms such as "processing" or "creating" or "transferring" or "executing" or "determining" or "detecting" or "obtaining" or "selecting" or "calculating" or "generating" or the like, refer to the action and processes of a computer system that manipulates and transforms data represented as physical (electronic) quantities within the computer's registers and memories into other data similarly represented as physical quantities within the memories or registers or other such information storage.

A computer-readable (storage) medium, such as referred to herein, typically may be non-transitory and/or comprise a non-transitory device. In this context, a non-transitory storage medium may include a device that may be tangible, meaning that the device has a concrete physical form, although the device may change its physical state. Thus, for example, non-transitory refers to a device remaining tangible despite a change in state.

As utilized herein, the term "example" means serving as a non-limiting example, instance, or illustration. As utilized herein, the terms "for example" and "e.g." introduce a list of one or more non-limiting examples, instances, or illustrations.

DESCRIPTION OF EMBODIMENTS

The present invention relates to an image capturing device for vibration frequency recognition in musical Instruments or non-musical devices (Visual Pickup).

The present solution is based on an employment of a video camera and picture analysis for a determination of string pitch (sound frequency) and the way of sound articulation (the way of making the string vibrate) and can provide a bit wider range of stringed instrument output data, which can be used in the later stage of sound synthesis and processing in MIDI based music related systems.

One additional advantage apart from the elimination of the undesired noise in the early stage of electric signal processing is eliminating the need of having a string with ferromagnetic qualities that are necessary to make the traditional coil based pickups detect the vibration of strings. In this way instruments having nylon or gut strings, typical for a harp, will also be suitable for the application of the presented here idea.

According to the invention presented in FIG. 1, a string frequency detector and converter (110) is based on a very high speed video camera module (111), a video data analysis module (112) for analyzing a position of each string, in pre-determined time video frames, and establishing elementary parameters of the produced sound so that a particular response may be generated by an output module (113) such as the frequency and amplitude of the vibrating string in a musical instrument (in this particular case-harp). Such output signal may be provided to a MIDI sound module (120).

The very high speed video camera module (111) may be a Fantom Miro 320S or FASTCAM Mini AX200 or the like. Their size and speed properties make them suitable for their application in sound producing instruments, where picture analysis is the source of information about the frequency and the qualities of the produced sound.

In another embodiment of the invention, each string may have an associated, separate camera. For example a guitar pickup having six strings and six cameras.

In yet another embodiment of the invention, each string may have only optic module associated with particular string which is further connected via optic fiber with the image capturing device. The installed on the stringed musical instrument optic module may be of single or multifocal type.

Figure 2:
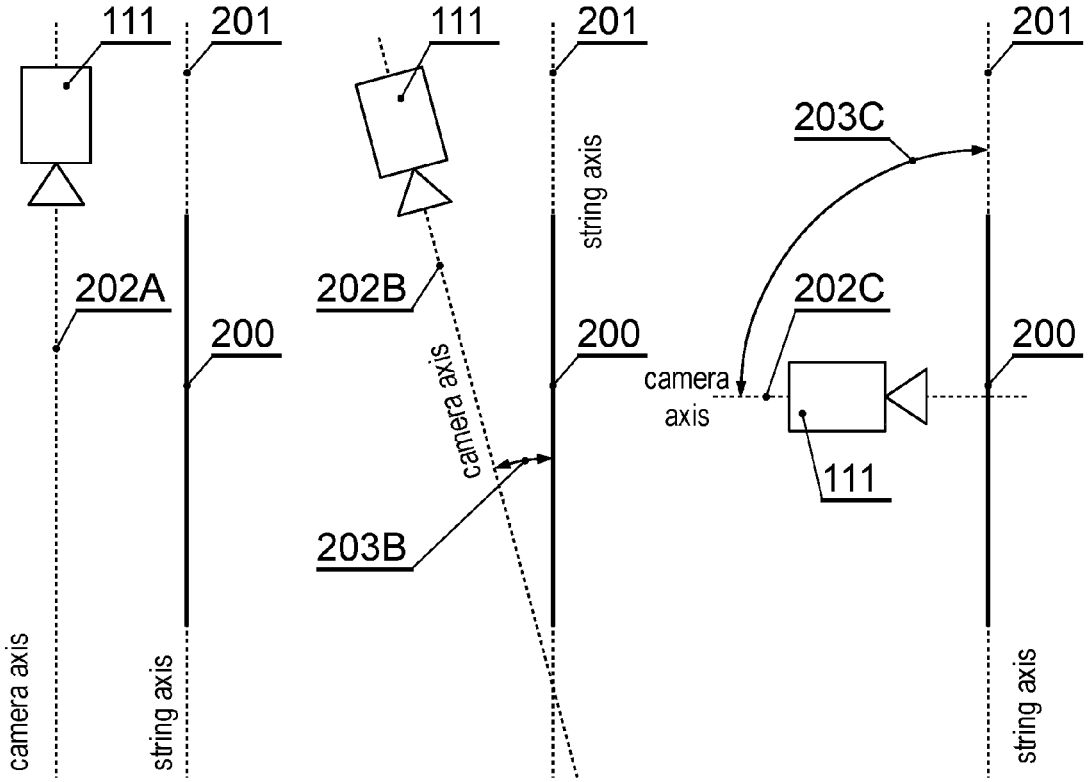
FIG. 2 presents examples of camera orientation.

A very high speed video camera (111) is mounted on the stringed instrument to obtain VIEW 1 of a string or a set of strings, as shown in FIG. 2.

FIG. 2 presents a camera (111) oriented with respect to a string (200) in three different positions. While the string (200) maintains its orientation axis (201), the camera orientation axis (202A, 202B, 202C) may vary in a given setup.

The way of mounting the camera (111) should ensure that the camera viewing axis be as close to the string axes as possible. In this way the camera has the most convenient position to observe the vibrations of strings. An example of the alignment of a camera and a still string may be that the camera viewing axis and the string axis are positioned such that an angle equal or lower than 90 degrees is formed. Similarly, in a preferred embodiment a distance of the camera from the string(s) is in a range of few millimeters to ten centimeters.

Figure 3:
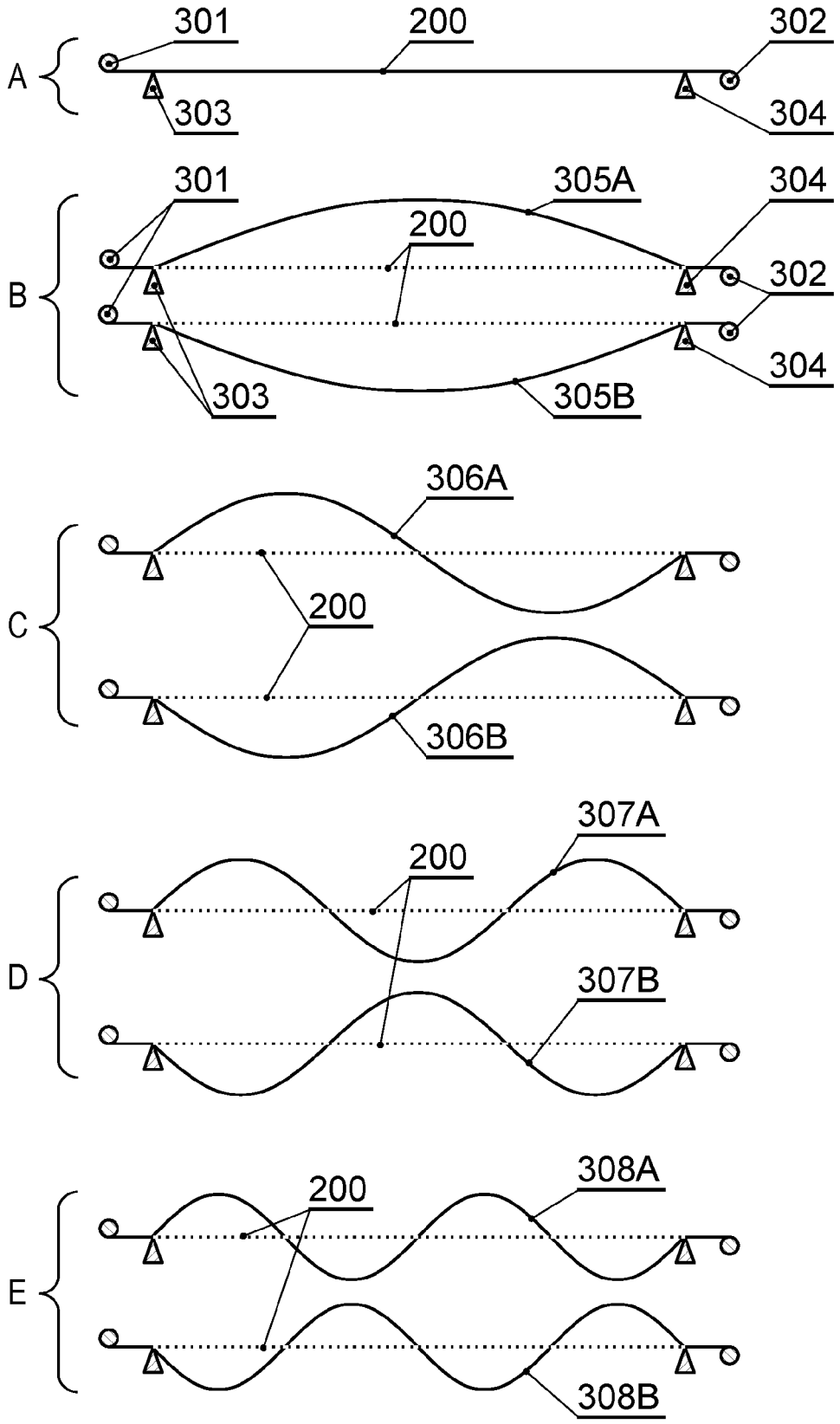
FIG. 3 presents examples of shapes of strings observed by a high speed video camera.

FIG. 3 presents examples of shapes of strings (200) observed by a high speed video camera (111) depending on the way of making the string vibrate.

In the case of a guitar, item (303) is a neck string nut while item (304) is a bridge string nut. Item (301) is a guitar tuning peg while item (302) is a bridge pin securing a string in a bridge.

In case of a harp, item (303) is equivalent to the harp's bridge pin or stationary string nut pin, item (304) is equivalent to the harp's eyelet and (302) is equivalent to the harper's knot securing the harp's string in the sound box and item (301) is equivalent to harp's tuning pin.

Picture A shows a still string (200), picture B shows the deflections of a string when vibrating at its whole length (305A, 305B), called in music at its fundamental frequency, picture C shows the deflections of a string vibrating at its 2nd harmonic (306A, 306B), picture D shows deflections of a string vibrating at its 3rd harmonic (307A, 307B) while picture E shows deflections of a string vibrating at its 4th harmonic (308A, 308B).

A camera capable of taking a series of pictures at the speed of at least two times higher than the frequency of the highest tone produced by a stringed instrument, according to the Nyquist—Shannon sampling theorem is able to provide reliable information about the frequency of the vibrating string when taking into account the known frequency of taking pictures (Nyquist rate) of the vibrating string or other source of sound.

The analysis of the deflection degree on the taken series of pictures can provide further information regarding the loudness of the sound and the way it fades out in time. What could be interesting to derive from the series of images captured by the High Speed Video Camera, is the way a string vibration is initiated. A camera picture can also provide meaningful information which after suitable picture processing can indicate the articulation of the produced by a string sound and influence the qualities of the sound generated by the MIDI sound modules triggered by a stringed instrument such as a harp.

Since the present size of Very High Speed Cameras is still relatively big and not suitable for their application for example in a classical guitar, a violin, or a mandolin, instead of having the cameras themselves mounted on the instrument, it is also possible to install only the optic part of the Very High Speed Video Cameras (VHSVC) on a stringed instrument and connect the optic part via optic fiber to the VHSVC located at a distance from the stringed instrument together with other MIDI sound modules or amplification systems.

Figure 4:
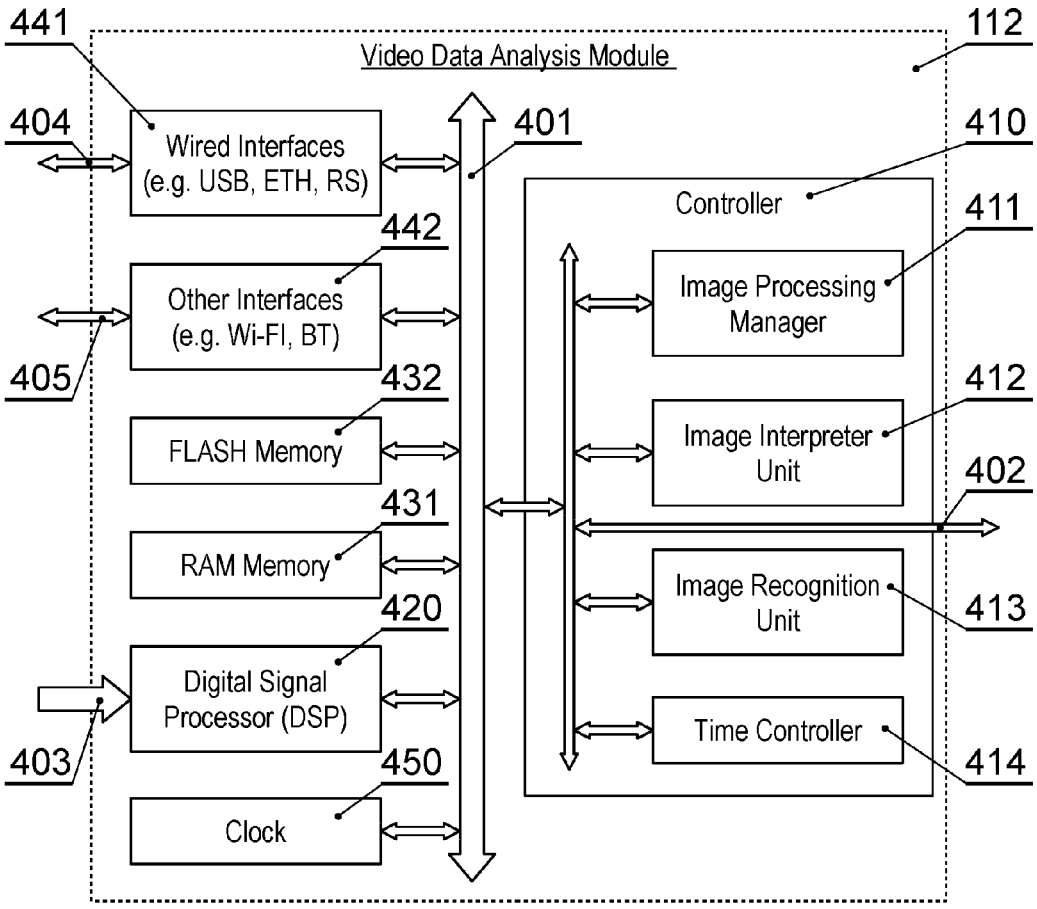
FIG. 4 shows details of video data analysis module.

FIG. 4 presents a diagram of the system according to the present invention, in particular the video data analysis module (112).

The system may be realized using dedicated components or custom made FPGA or ASIC circuits. The system comprises a data bus (401) communicatively coupled to a RAM memory (431) and a non-volatile FLASH memory (432). Additionally, other components of the system are communicatively coupled to the system bus (401) so that they may be managed by a controller (410).

The memory (432) may store computer program or programs executed by the controller (410) in order to execute steps of the method according to the present invention. Additionally, the memory (432) may store any configuration data of the system. Such configuration data may include information regarding one or more of the following:

- sound frequencies associated with sounds produced by each string in a given stringed instrument;
- images of strings in still states as reference for any computing purposes in an Image Interpreter Unit;
- MIDI messages as specified by the MIDI standard;
- nominal names of strings associated with corresponding sound frequencies strings produce when they are tuned. Each string in a musical instrument is featured by its name which corresponds to the sound the string produces when it obtains its nominal tension (in other words when the given string is tuned;
- parameters describing possible lengths of strings (identified groups of pixels as string lengths);
- lengths of strings and corresponding frequencies when strings are tuned to their nominal values. In a harp, each tuned via tuning pins string may be additionally shortened by a set of tuning discs driven by the harp's pedals. By pressing pedals the instrumentalist shortens the length of the harp's strings (shortens the length between the first and the last nut) by a pre-defined length and obtains respectively higher sound. The action of the tuning discs could be compared to pressing a string on a fret in a fretted stringed musical instrument. In fretted stringed instruments it is possible to pre-define frequencies produced by a tuned string for each fret. E.g. if a tuned string e1 in a classical guitar is pressed on the first fret it will produce f1 sound. When the same tuned string is pressed on the second fret, it will produce f#1 sound, on the third fret, it will produce g1 sound. Similarly, for each string in a fretted stringed musical instrument configuration data stored in system memory may hold pre-defined frequencies corresponding to each string pressed on each fret. This pre-definition of sounds may allow to avoid the frequency recognition process in the cases of fretted stringed instruments.
- device viewing axis (202A, 202B, 202C), string axes (201), and the axis (608) describing the trajectory of the identified pixel (616A), (616B), (616C), (616D),
- angular correlation of axes (201), (202A), (202B), (202C) and (608);
- resolution of images delivered by image capturing devices;
- image capturing device viewing perspective (202A), (202B), (202C) compensation parameters for image pixels;
- samples of predefined acoustic effects available for matching with user defined groups of pixels derived from image decomposition and analysis.

A clock (450) is responsible for generating timing control of taking pictures by the camera (111). Each taken picture shall be associated with a time stamp. A suitable command triggering the camera (111) may be issued via a wired (404) or wireless (405) communication interface by a time controller (414).

Data received from the camera (111) may be processed by a digital signal processor (420) in order to obtain a frame sample to be stored in memory for further reference by the controller (410).

The controller (410) comprises an image processing manager (411) responsible for controlling an image interpreter unit (412) and an image recognition unit (413).

The Image Recognition Unit (413) is responsible for identifying meaningful elements of the captured scene that during a further stage can be a source of information of a string frequency, string vibration initiation, or other here undefined features. The elements may include, for example, recognition of a collection of pixels depicting particular strings of the musical instrument. Another recognized element of the captured scene may include string name identification as each string in a musical instrument is featured by a name corresponding to a particular sound the string achieves when it obtains its designed nominal tension.

Yet another feature recognized by the Image Recognition Unit may be the identification of those elements of the captured scene that are irrelevant to producing sound parameters. Eliminating the irrelevant elements of the scene helps to limit the amount of data subject to transfer and consequently to shorten the time needed to recreate the frequency of the vibrating string without the sense of delay that may appear if the time from the physical sound initiation moment till the moment the sound is reproduced exceeds 30 ms.

The Image Recognition Unit may also define various groups of pixels of the captured scene which change in time at the speed indicating players activity rather than musical instrument's frequency response.

The identified captured scene elements in the Image Recognition Unit (413) are delivered to the Image Interpreter Unit (412) where the identified scene elements are further translated onto various sound parameters.

This module is responsible for calculating the frequency of the vibrating string and outputting the results of the calculation at intervals shorter than 30 ms. Also, this module translates the identified scene elements into other sound features typical for a sound such as articulation or the way of string vibration initiation. Image Interpreter Unit may either match the identified scene elements with pre-defined sound features or produce the sound features each time it receives meaningful information from the Image Recognition Unit.

Figure 5A:
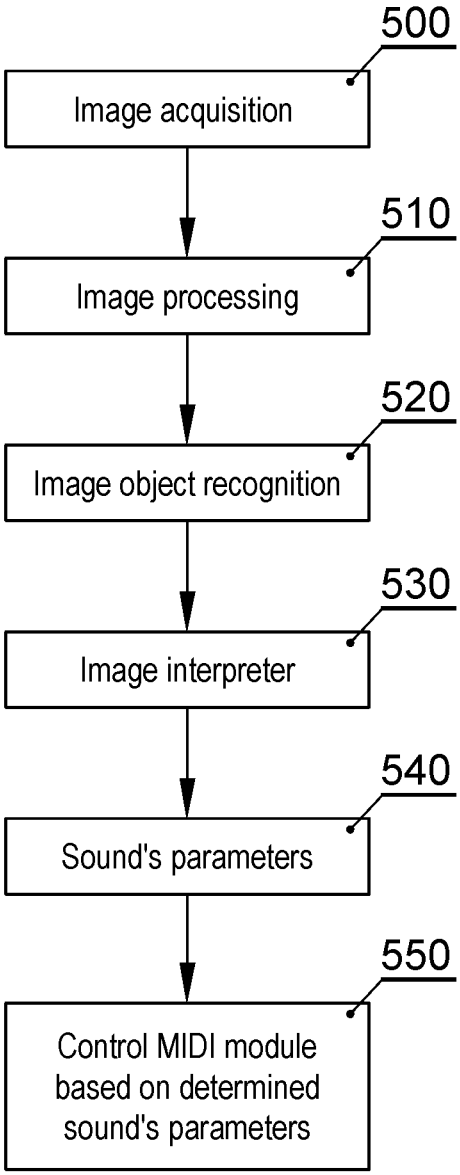
FIG. 5A depicts a general overview of the method according to the present invention.

FIG. 5A presents a diagram of the method according to the present invention. The method starts at step (500) where a very high speed image capturing device captures image frames containing views of musical instrument strings. The rate with which the frames are delivered is controlled by the Clock (450) and is at least twice as high as the highest frequency a given musical stringed instrument is able to produce. Image frames containing the views of strings are then decomposed in image processing step (510) where the irrelevant elements of the captured scene as well as the elements which carry meaningful information are identified. This stage of the process removes the irrelevant elements of the captured scene.

Subsequently, step (520) allows to differentiate various groups of the captured scene, tag them and make them the subject of further analysis. Image Interpreter (530) processes the meaningful elements of decomposed image frames. Processing the chosen meaningful elements of the decomposed image frames leads to establishing the parameters of sounds produced by the musical instrument. Establishing sound parameters takes place in the step (540) where the obtained information (of amplitude and frequency) is matched with corresponding MIDI messages that are capable of driving external MIDI sound modules. Sound parameters obtained in (540) may also be presented in such a way which will make them suitable for influencing new sound synthesis.

In particular, there is executed comparing of the still state reference image with a vibrating state reference image in order to find amplitude of vibrations of each string as well as frequency of each string vibrations based on amplitude height in pixels with reference to the still state and determining a frequency of each vibrating string on the basis of the number of pixels between two nuts of a half-period of a given periodic function.

Figure 5B:
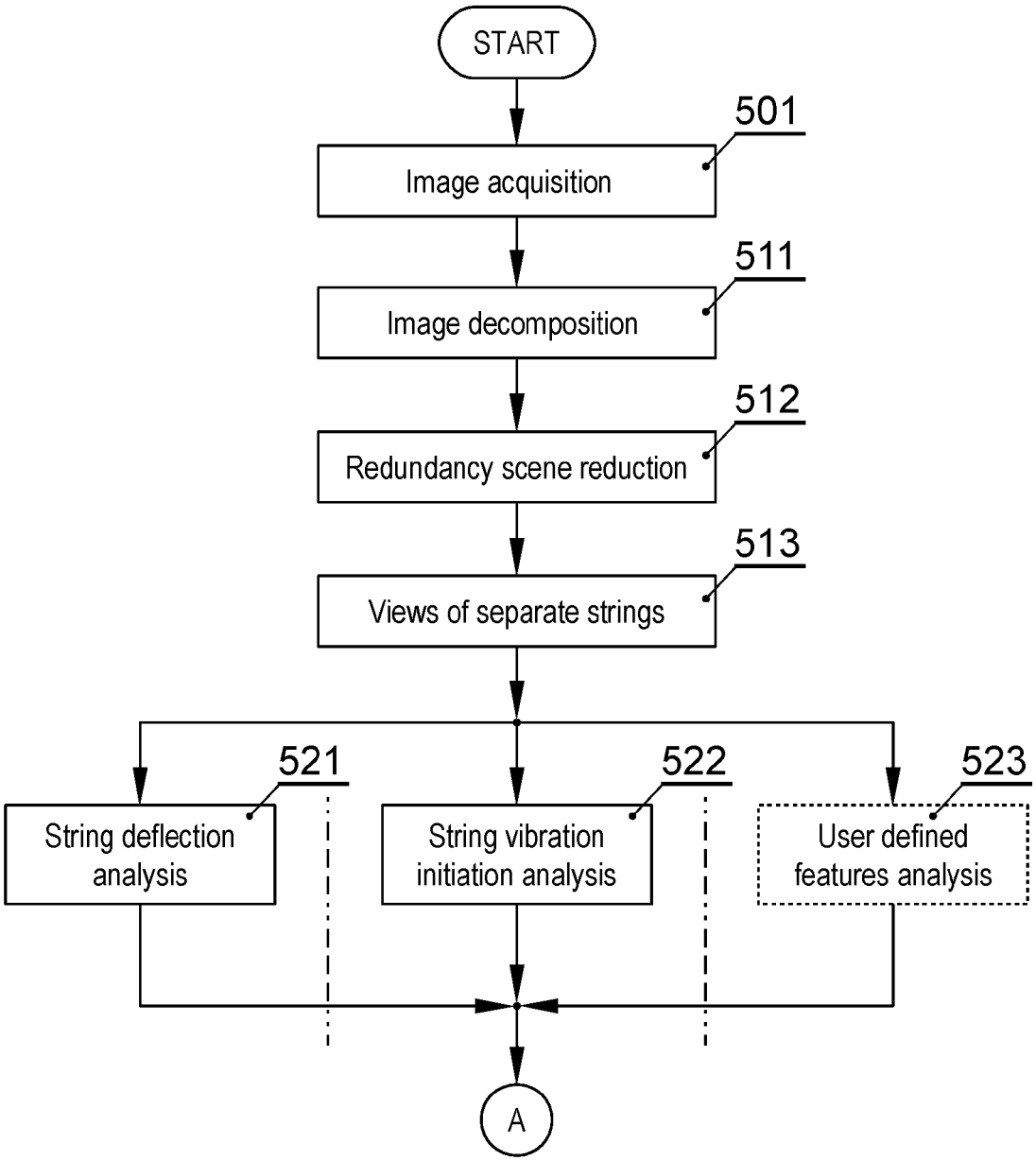
FIG. 5B depicts a more detailed diagram of the method presented in FIG. 5A focusing only on blocks 500, 510, and 520.
Figure 5C:
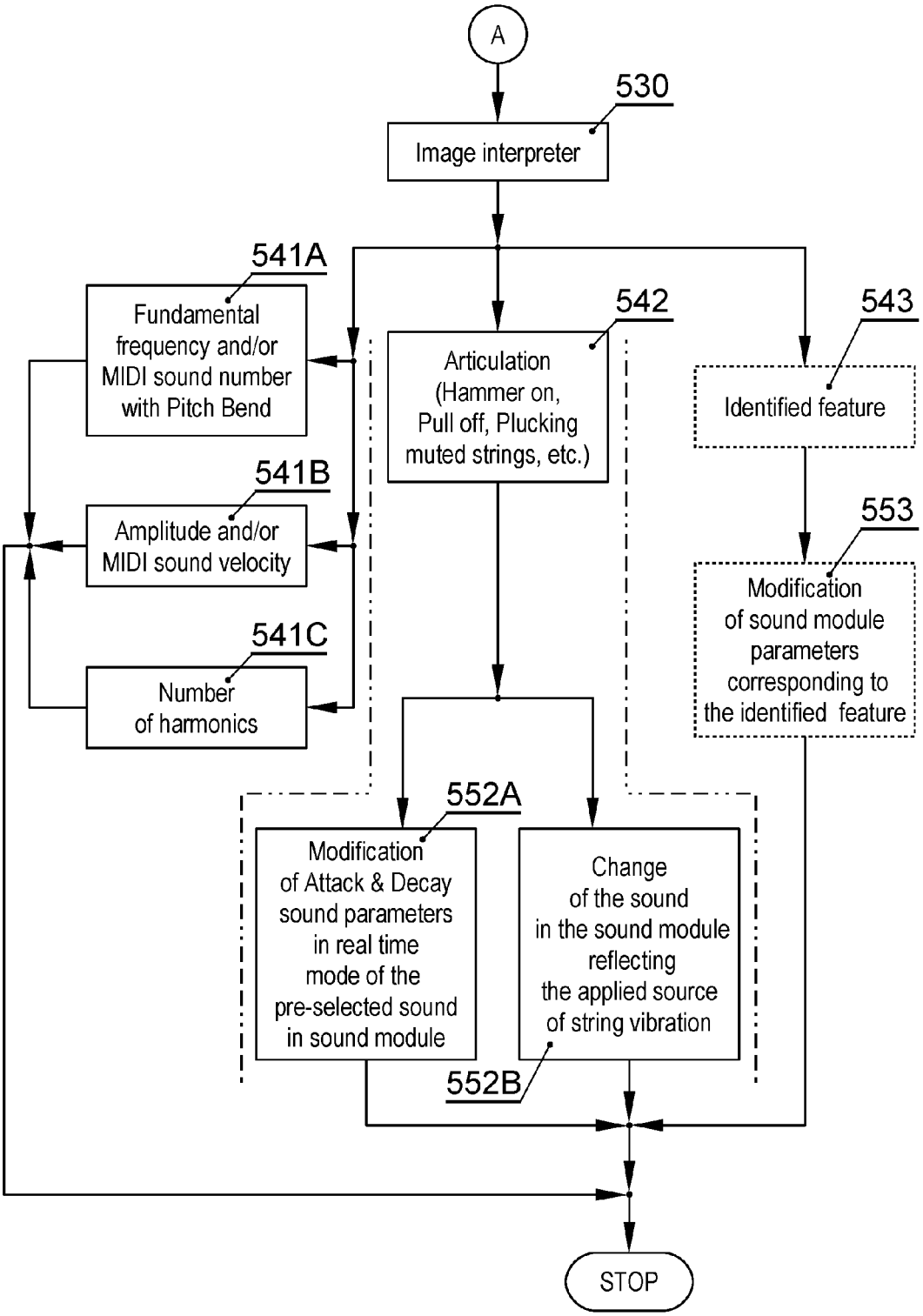
FIG. 5C depicts a more detailed diagram of the method presented in FIG. 5A focusing only on blocks 530, 540, and 550.

A more detailed diagram of the method presented in FIG. 5A is presented in FIG. 5B and FIG. 5C. Delivered by (500) or (501) image frames are subject of image processing (510) which could be further illustrated in a more detailed way by three stages (511), (512), and (513).

Delivered images containing views of strings are decomposed into groups of pixels representing strings, relevant scene background, irrelevant scene background, and groups of pixels known in MPEG compression standards as macro blocks featured by their motion vector indicating the instrumentalist's playing action. These macro blocks are further tagged for example as instrumentalist's fingers, finger tips, nails, plectrum, palm. Any user defined names could be assigned to the selected groups of pixels (macro blocks).

The system also identifies those groups of pixels in the captured scene that have no influence on the process of sound parameters identification. Those groups of pixels in the captured scene are removed to limit the bitrate ratio and consequently shorten the time lapsing from the moment of physical sound initiation till the moment of sound reproduction. The identification of irrelevant groups of pixels takes place in the step (512).

Next, having the decomposed image frames where various relevant groups of pixels have been identified and tagged, groups of pixels representing separate strings are obtained (513). This stage of the method also presents groups of pixels identified and tagged as instrumentalist's various playing means which affect the way a particular string vibration is initiated. Image object recognition generally presented by (520) is further described by (521), (522), (523) where (521) carries out the analysis of changes of the groups of pixels representing strings in consecutive image frames, (522) identifies which group of pixels (which macro blocks) in consecutive image frames represent particular way of string vibration initiation, and (523) decides which user defined groups of pixels in consecutive image frames can be assigned user defined sound parameters.

Image interpreter (530) obtains the results of analysis performed by by (521), (522), (523) and correlates the results allowing the (540) to form sound parameters having information whether the particular sound is generated by plucking with the use of a plectrum, finger tip, nail, hammer on or pull off or other user defined technique and combining this with the sound frequency or suitable MIDI message carrying information about sound parameters or with other messages capable of driving any sound synthesis module parameters. In this particular embodiment the sound parameters comprise the sound fundamental frequency, its corresponding MIDI sound number together with possible Pitch Bend messages (541A), sound amplitude or MIDI sound velocity parameters (541B), or the number of harmonics (541C) a string is vibrating at.

The results of analysis released by (522) and (523) may further be processed by Image interpreter (530) to release commands and messages influencing MIDI sound module or sound synthesis module settings as indicated by (552A), (552B) or (553).

One possible method of obtaining the information about frequency, of a vibrating string in a stringed instrument, may include the following steps.

Image of a tuned still string is captured and kept in memory as a reference. Prior to writing in memory, the captured image is analyzed and decomposed. A group of pixels representing a given string, in a still state, is identified and kept in memory.

Figure 6:
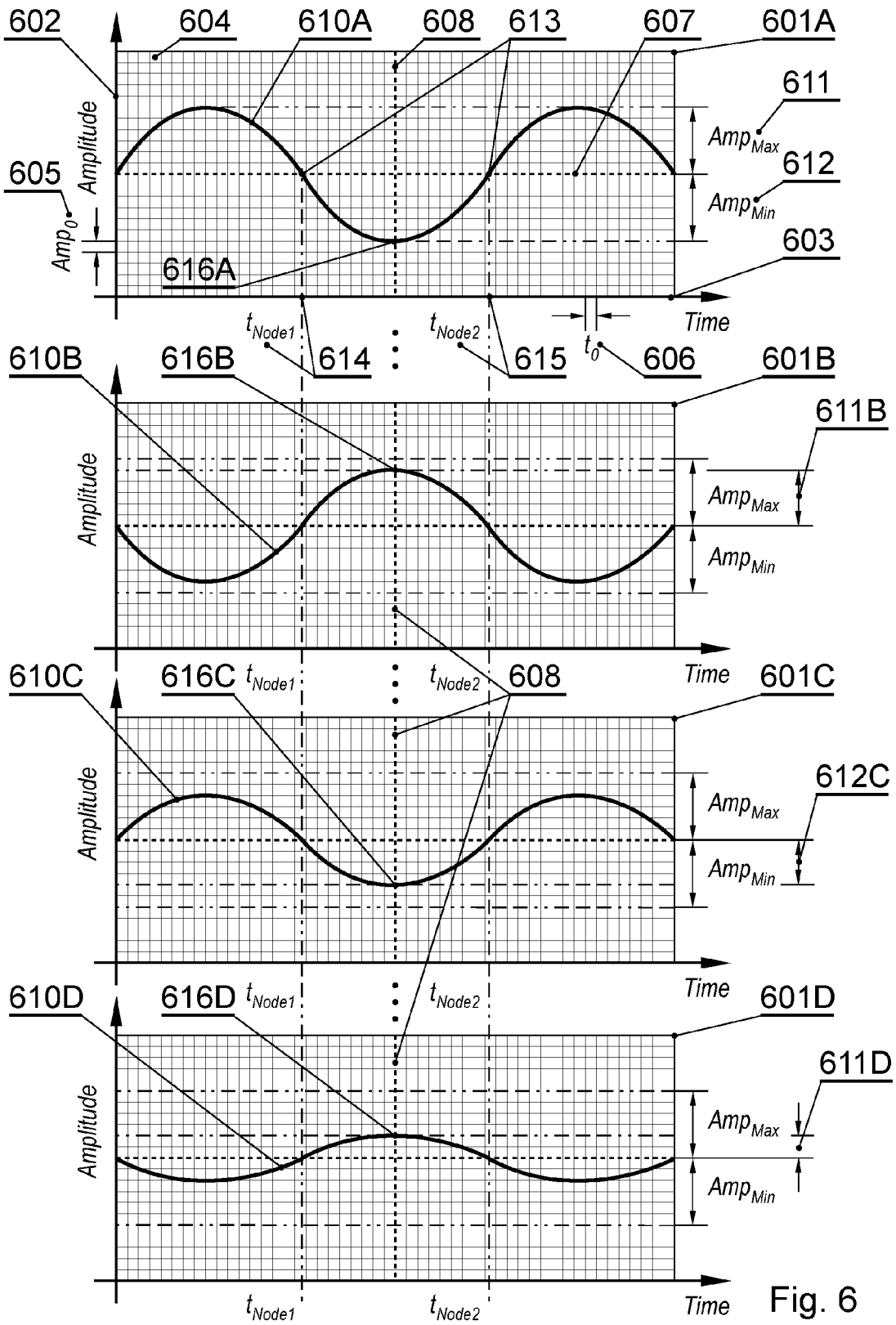
FIG. 6 presents views of groups of pixels representing a string vibrating at its third harmonic.

Next, image with strings is calibrated in such a way that a string of a known vibration frequency vibrating at its non fundamental frequency is captured in a frame (see FIG. 6, 610A). Next, the system identifies common pixels of two groups of pixels. One group of a still string (607) and the second group of the vibrating string (610A). Common pixels denote nodes (613) of the vibrating string.

Knowing the calibrating frequency of the vibrating string, and a number of pixels between two nodes (613) of the half-period, applying formula from FIG. 8 (801), a time per pixel (606) is calculated. Obtaining the value (606) ends the calibration process. The higher resolution of the image and consequently the number of pixels available in the image the more precise is the calibration process and further other frequencies identification performed on the basis of the calibration and calculated time per pixel.

In order to calculate other frequencies of strings, vibrating at their non-fundamental frequencies (803A), there may be applied the same formula known from FIG. 8 (801), where having common pixels denoting nodes of the vibrating strings, knowing the number of pixels between the nodes, and having the calculated Constant time per pixel (606), there may be obtained a frequency of the string (803A) vibrating at its non-fundamental frequency.

The constant value (606) allows to calculate the string vibration frequency when the string is vibrating at its fundamental frequency. Formula (802) allows to compute the sound frequency (803B). In this method of string vibration frequency identification, the (606) Constant is applied to calculate the time the group of pixels representing the vibrating string moves from their one extreme deflection from its still state (710A) to the opposite maximum deflection from the still state (710D).

Another method of string vibration frequency identification, that does not require the calibration process, may comprise the following steps An image of a still string is captured and kept in memory as reference. Prior to writing in memory the captured image is analyzed and decomposed. A group of pixels representing a given string in a still state (707) or (607) is identified and kept in memory.

The image capturing device delivers images of a string with the rate higher or equal to 6 [kHz]. The exposure time of the captured images allows to deliver unmoved (sharp and focused) images of deflected strings like in (710A), (710B), (710C), (710D), (610A), (610B), (610C), (610D).

The method identifies a pixel in the group of pixels representing the deflected string, which is located further away (616A) from the axis drawn by the group of pixels representing the still string and assigns to that pixel an electric value proportional to the number of pixels on the axis drawn perpendicularly (608) to the still string axis from the position of the most distant pixel till the still string axis as indicated by (612), (611B), (612C) or (611D).

The axis (608) which is perpendicular to the still string (201), (607), (707) axes may additionally be checked at least every second pair of captured images to verify if axis (608) does not pivot on the still string axis (201), (607), (608). If pivoting action is detected, the corresponding correction co-efficient is applied in assigning an electric value for the pixel being the subject of analysis. The correction co-efficient is the result of angular co-relation of (608) with (201) or (607) or (608), and with (202A) or (202B) or 202C).The angle of both axes (608) and (607) or (707) may additionally be correlated with the image capturing device viewing axis (202A), (202B), or 202C). For the above description it has been assumed that the trajectory of the most deflected pixel located on the group of pixels representing the vibrating string moves along (608) axis, which is perpendicular to the still string axis (607) or (707) where the image capturing device viewing axis (202C) creates a right angle (203C) with the still string axis (201), or (607) or (707).

A similar analysis takes place on each consecutive image, delivered by the image capturing device, until another pixel is identified whose position is further away from the still string axis than the position of the pixel being the subject of current analysis.

In this way, a series of discrete values is obtained, each time proportional to the number of pixels between the most distant position of a pixel from the still string axis and the point of juncture of the two axes (608) and (607) or (707), or (201).

Additionally, the values (612), (611B), (612C), or (611D) obtain + or − sign depending on the side the pixels are located with reference to the still string axis (607) or (707) or (201).

Figure 7:
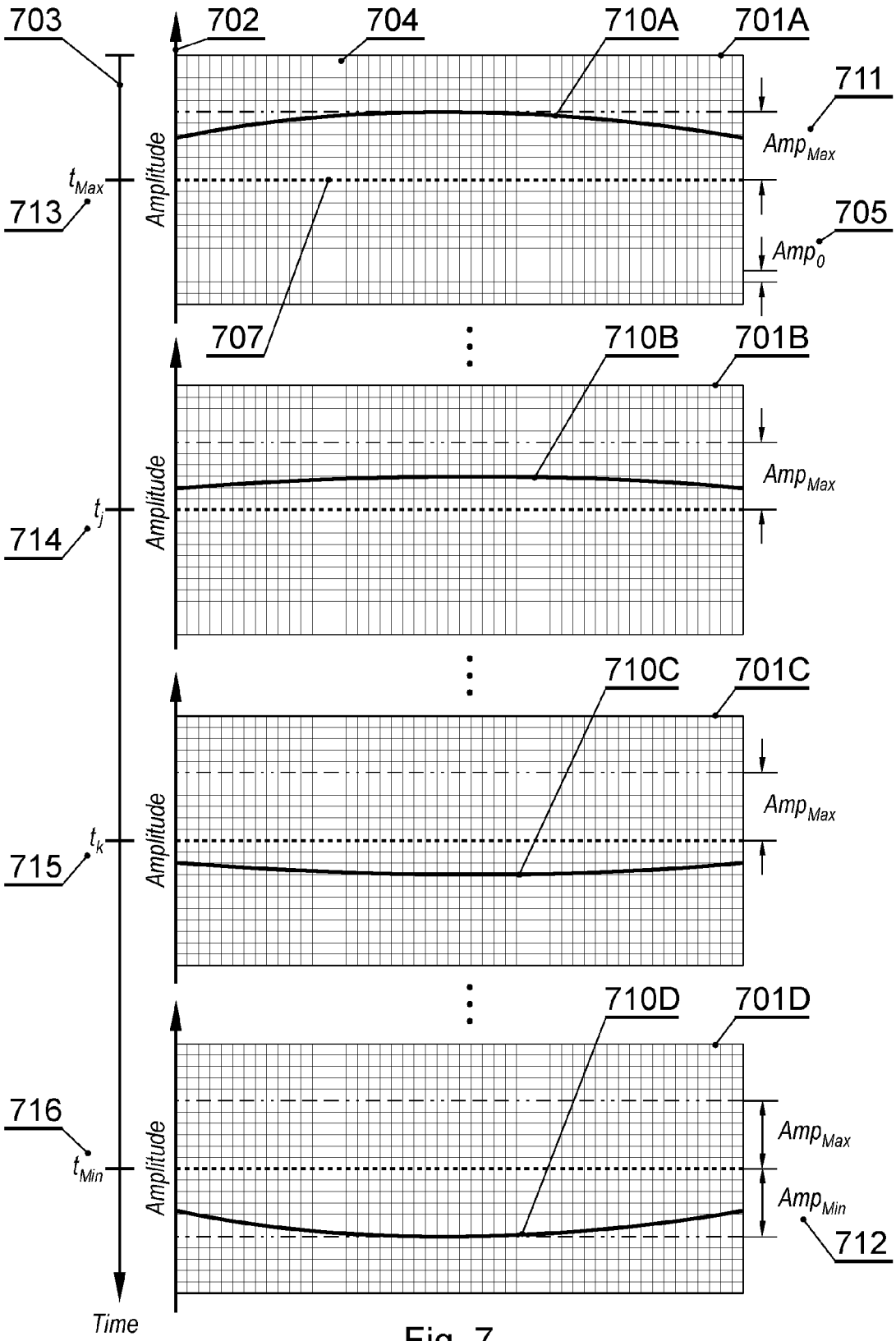
FIG. 7 presents views of groups of pixels representing a string vibrating its fundamental frequency.

In this way, a series of values are created which represent samples of sound frequencies or in other words discrete-time signals derived from the vibrating string depicted in FIG. 6 or FIG. 7.

The discrete-time signals are stored in memory until the system releases the information about the frequency of the vibrating medium here (610A), (610B), (610C), (610D) or (710A), (710B), (710C), (710D). The information about the frequency of the produced sound is released by a digital to analogue converter being the part of the output module (113).

Forming and releasing the information about the sound frequency and amplitude produced by the stringed instrument in the digital to analogue converter takes place in time intervals equal to the full vibration period of tones a musical stringed instrument produces. The time interval should not exceed 30 milliseconds to avoid the sense of delay which may appear if the sound formation takes place later than 30 milliseconds from the time of physical sound initiation. The information about the frequency produced by the stringed instrument sound may further be matched either with corresponding MIDI messages which could be used for driving an external MIDI sound modules (120).

Yet another way of deriving the information about the string vibration frequency is based on comparison. The comparison of the string length against the held-in-memory information on the length of the string, its nominal name and its frequency at its nominal tension. This method requires the calibration process where the image capturing device provides the image of strings in their still state at their nominal tension.

The image is analyzed, decomposed and the image of each string as a group of pixels is held in memory. Each group of pixels representing particular string is assigned a corresponding name and frequency associated with the string name at its nominal tension according to the following table:

The table below lists music sounds and their corresponding frequencies divided into octaves which may be kept in memory as reference.

| Octave | Sound | Frequency [Hz] |
|---|---|---|
| Sub Contra | C2 | 16,351598 |
| | Cis2 | 17,323915 |
| | D2 | 18,354048 |
| | Dis2 | 19,445437 |
| | E2 | 20,601723 |
| | F2 | 21,826765 |
| | Fis2 | 23,124652 |
| | G2 | 24,499715 |
| | Gis2 | 25,956544 |
| | A2 | 27,500000 |
| | Ais2 | 29,135235 |
| | B2 | 30,867707 |
| Contra | C1 | 32,703196 |
| | Cis1 | 34,647829 |
| | D1 | 36,708096 |
| | Dis1 | 38,890873 |
| | E1 | 41,203445 |
| | F1 | 43,653529 |
| | Fis1 | 46,249303 |
| | G1 | 48,999430 |
| | Gis1 | 51,913088 |
| | A1 | 55,000001 |
| | Ais1 | 58,270471 |
| | B1 | 61,735413 |
| Great | C | 65,406392 |
| | Cis | 69,295658 |
| | D | 73,416193 |
| | Dis | 77,781747 |
| | E | 82,406890 |
| | F | 87,307059 |
| | Fis | 92,498607 |
| | G | 97,998860 |
| | Gis | 103,826175 |
| | A | 110,000001 |
| | Ais | 116,540942 |
| | B | 123,470827 |
| Small | c | 130,812784 |
| | cis | 138,591317 |
| | d | 146,832385 |
| | dis | 155,563493 |
| | e | 164,813780 |
| | f | 174,614118 |
| | fis | 184,997213 |
| | g | 195,997720 |
| | gis | 207,652351 |
| | a | 220,000002 |
| | ais | 233,081883 |
| | b | 246,941653 |
| First Line | c1 | 261,625568 |
| | cis1 | 277,182634 |
| | d1 | 293,664771 |
| | dis1 | 311,126987 |
| | e1 | 329,627560 |
| | f1 | 349,228235 |
| | fis1 | 369,994427 |
| | g1 | 391,995440 |
| | gis1 | 415,304702 |
| | a1 | 440,000005 |
| | ais1 | 466,163766 |
| | b1 | 493,883306 |
| Second Line | c2 | 523,251136 |
| | cis2 | 554,365268 |
| | d2 | 587,329542 |

-continued

| Octave | Sound | Frequency [Hz] |
|---|---|---|
| | dis2 | 622,253974 |
| | e2 | 659,255121 |
| | f2 | 698,456470 |
| | fis2 | 739,988853 |
| | g2 | 783,990880 |
| | gis2 | 830,609404 |
| | a2 | 880,000009 |
| | ais2 | 932,327533 |
| | b2 | 987,766613 |
| Third Line | c3 | 1046,502272 |
| | cis3 | 1108,730535 |
| | d3 | 1174,659084 |
| | dis3 | 1244,507948 |
| | e3 | 1318,510241 |
| | f3 | 1396,912940 |
| | fis3 | 1479,977706 |
| | g3 | 1567,981760 |
| | gis3 | 1661,218807 |
| | a3 | 1760,000018 |
| | ais3 | 1864,655065 |
| | b3 | 1975,533225 |
| Fourth Line | c4 | 2093,004544 |
| | cis4 | 2217,461071 |
| | d4 | 2349,318168 |
| | dis4 | 2489,015895 |
| | e4 | 2637,020483 |
| | f4 | 2793,825880 |
| | fis4 | 2959,955412 |
| | g4 | 3135,963520 |
| | gis4 | 3322,437615 |
| | a4 | 3520,000036 |
| | ais4 | 3729,310131 |
| | b4 | 3951,066451 |
| Fifth Line | c5 | 4186,009088 |
| | cis5 | 4434,922141 |
| | d5 | 4698,636335 |
| | dis5 | 4978,031791 |
| | e5 | 5274,040965 |
| | f5 | 5587,651761 |
| | fis5 | 5919,910824 |
| | g5 | 6271,927040 |
| | gis5 | 6644,875230 |
| | a5 | 7040,000073 |
| | ais5 | 7458,620261 |
| | b5 | 7902,132902 |
| Sixth Line | c6 | 8372,018176 |
| | cis6 | 8869,844283 |
| | d6 | 9397,272670 |
| | dis6 | 9956,063582 |
| | e6 | 10548,081930 |
| | f6 | 11175,303521 |
| | fis6 | 11839,821649 |
| | g6 | 12543,854081 |
| | gis6 | 13289,750460 |
| | a6 | 14080,000145 |
| | ais6 | 14917,240522 |
| | b6 | 15804,265803 |

The image capturing device delivers images of strings at the rate of 6 kHz or higher. When a string vibration is initiated, the image capturing device begins to deliver a series of images where the group of pixels representing strings takes a deflected position. The higher the amplitude of the vibrating string, the bigger the difference is obtained when two images, one of a string in a still state and the other of a string in deflected position, are compared.

By combining two parameters, the length of the string and the result of image comparison where the image of a still string is compared with the image of a deflected string, the information on the sound frequency and its duration may be derived.

Using the aforementioned methods of image analysis one can obtain information capable of driving MIDI sound modules or devices specialized in sound synthesis not only from stringed instruments featured by strings of ferromagnetic qualities, but also from stringed musical instruments that are featured by nylon or gut strings. Using image analysis as the source of information about the observed sound, additionally allows to avoid presently known methods prone to external noise and interference. Therefore, the invention provides a useful, concrete and tangible result.

The presented invention captures image data and processes the data in order to determine sound parameters. Thus, the machine or transformation test is fulfilled and that the idea is not abstract.

At least parts of the methods according to the invention may be computer implemented. Accordingly, the present invention may take the form of an entirely hardware embodiment, an entirely software embodiment (including firmware, resident software, micro-code, etc.) or an embodiment combining software and hardware aspects that may all generally be referred to herein as a "circuit", "module" or "system".

Furthermore, the present invention may take the form of a computer program product embodied in any tangible medium of expression having computer usable program code embodied in the medium.

It can be easily recognized, by one skilled in the art, that the aforementioned method for stringed instruments' pickup may be performed and/or controlled by one or more computer programs. Such computer programs are typically executed by utilizing the computing resources in a computing device. Applications are stored on a non-transitory medium. An example of a non-transitory medium is a non-volatile memory, for example a flash memory while an example of a volatile memory is RAM. The computer instructions are executed by a processor. These memories are exemplary recording media for storing computer programs comprising computer-executable instructions performing all the steps of the computer-implemented method according the technical concept presented herein.

While the invention presented herein has been depicted, described, and has been defined with reference to particular preferred embodiments, such references and examples of implementation in the foregoing specification do not imply any limitation on the invention. It will, however, be evident that various modifications and changes may be made thereto without departing from the broader scope of the technical concept. The presented preferred embodiments are exemplary only, and are not exhaustive of the scope of the technical concept presented herein.

Accordingly, the scope of protection is not limited to the preferred embodiments described in the specification, but is only limited by the claims that follow.

The invention claimed is:

1. A method for stringed instruments' pickup the method comprising steps of:

capturing images of mechanical vibrations of at least one string; and converting images to a signal representative of a string's current state the method being characterized in that the capturing comprises the following steps:

capturing, using an image capturing device, image frames comprising views of at least one musical instrument's string in a still state;

storing the captured image as a reference of a still state;

capturing (500), using the image capturing device, image frames comprising views of at least one musical instrument's string in a vibrating state;

storing the captured image as a reference of a vibrating state;

comparing (520) the still state reference with a vibrating state reference in order to find (530) amplitude of vibrations of each string as well as frequency of each string vibrations based on amplitude height in pixels with reference to the still state and determining a frequency of each vibrating string on the basis of the number of pixels between two nuts of at least half-period of a given periodic function.

2. The method according to claim 1 wherein the rate with which the frames are delivered is controlled by a clock (450) and is at least twice as high as the highest frequency a given musical stringed instrument is able to produce.

3. The method according to claim 1 wherein before the comparing step (520), an image processing step (510) is executed where the irrelevant elements of the captured scene as well as the elements which carry meaningful information are identified.

4. The method according to claim 1 wherein the method further comprises a step (540) wherein the obtained information of amplitude and frequency of at least one vibrating string is matched with corresponding MIDI messages that are capable of driving external MIDI sound modules or sound synthesis modules.

5. The method according to claim 1 wherein the given periodic function is a sine or cosine.

6. The method according to claim 1 wherein the image capturing device viewing axis (202C) creates an angle (203C, 203B) with the still string axis (201, 607, 707) in the range of 0 to 90 degrees.

7. The method according to claim 1 wherein determining the frequency includes calculating a time per pixel on the basis of a known calibrating frequency of a vibrating string, and a number of pixels between two nodes (613) of half-period and applying the following formula:

$$f_{Sound} = \frac{1}{2 \cdot (t_{Node\ 2} - t_{Node\ 1})}.$$

8. The method according to claim 1 wherein the comparing step is based on a correlation of a still string axis (201, 607, 707), and the camera viewing axis (202A, 202B, 202C), and the most distant pixel's (616A, 616B, 616C, 616D) trajectory axis.

9. The method according to claim 1 wherein the information about the sound frequency and amplitude, produced by the stringed instrument, takes place in time intervals equal to, at least, the full vibration period of the identified tone.

10. A non-transitory computer readable medium storing computer-executable instructions performing all the steps of the computer-implemented method according to claim 1 when executed on a computer.

11. A system for stringed instruments' pickup the system comprising:

a video camera module (111);

a video data analysis module (112) configured to execute all steps of the method according to claim 1;

and output module (113) outputting frequency and amplitude of at least one vibrating string in the musical instrument.

* * * * *